United States Patent [19]

Walters et al.

[11] 4,274,528

[45] Jun. 23, 1981

[54] COIN SEPARATOR ASSEMBLY

[75] Inventors: Robert N. Walters; Kristen H. Dietz, both of Florissant, Mo.

[73] Assignee: Coin Acceptors, Inc., St. Louis, Mo.

[21] Appl. No.: 86,682

[22] Filed: Oct. 19, 1979

[51] Int. Cl.[3] ..... G07F 3/02

[52] U.S. Cl. ..... 194/102

[58] Field of Search ..... 194/99, 102, 97 R, 97 A; 133/3 R

[56] References Cited

U.S. PATENT DOCUMENTS 483,188 9/1892 Volkmann ..... 194/102

*Primary Examiner*—Stanley H. Tollberg

*Attorney, Agent, or Firm*—Cohn, Powell & Hind

[57] ABSTRACT

A coin separator assembly for a coin-selecting device in which a separator member is hingedly mounted to a gate for swinging movement relative to a coin chute defined by the gate and a main plate. The main plate includes vertically spaced abutments, and the separator member includes a coin spaced from the hinge axis and a rail disposed below the cam. The separator member is biased from a position, in which a coin of predetermined diameter is held against sideways movement by the action of the cam and the spaced abutments and against downward movement by the rail, to a position in which a diametrically undersized coin is tilted by the cam and the rail is moved out of the path of the coin to permit continued downward movement thereof. The rail is of a width such that engagement of the cam by an under-thick coin moves the separator member into a position in which the rail is out of the path of the coin to permit continued downward movement thereof.

8 Claims, 7 Drawing Figures

COIN SEPARATOR ASSEMBLY

BACKGROUND OF THE INVENTION

This invention relates generally to an improved coin separator assembly and more particularly to an assembly which directs coins of a certain diametrical range into one path and directs diametrically undersized coins and underthick coins into another path.

Vending machines of the type which receive coins of different value require in some instances that some coins of different value be directed, at least initially, into the same path. Such machines also require that other coins of different value be directed into different paths. It is also desirable in most machines that underthick coins or slugs be rejected. There have been problems in devices used for this purpose in the past because of their relative complexity, and the resulting expense of manufacture. In addition, such devices have frequently presented maintenance and adjustment problems. This separator assembly overcomes these and other problems.

SUMMARY OF THE INVENTION

The present separator assembly provides a simple mechanical means for directing coins of a particular diametrical range into one path and coins below that range into another path. In addition, the assembly provides for the direction of underthick coins into the same initial path as diametrically undersized coins.

The separator assembly includes first and second plates, one of said plates including a coin engageable abutment means. A separator member is mounted in swinging relation to one of said plates and includes a first coin engageable means disposed in spaced relation from the hinge axis, and a second coin engageable means disposed in spaced relation from the hinge axis below said first coin engageable means. Biasing means is provided for the separator member tending to bias said member from a first position, in which a coin of one diameter range is supported against sideways movement by the abutment means on one side and said first engageable means on the other side and supported against downward movement by said second engageable means, into a second position, in which a coin of lesser diameter is tilted by said first engagement means to one side and said second engagement means is moved away from supporting engagement with said coin of lesser diameter to permit said coin to move in a generally downward direction.

In one aspect of the invention the second coin engageable means includes a rail supporting said coin of one diameter range in said first position to direct said coin in a generally transverse direction, said rail having a space adjacent thereto receiving said tilted coin in said second position.

In another aspect of the invention the second coin engageable means includes a rail of a width such that engagement by said first coin engageable means of a coin of said one diameter range but having a lesser thickness moves said rail into a third position in which said rail moves away from supporting engagement with said coin of lesser thickness and into a space adjacent said rail.

In another aspect of the invention the biasing means is a spring disposed between the separator member and one of said first and second plates.

In yet another aspect of the invention the first coin engageable means includes a cam and said abutment means includes vertically spaced abutments disposed above and below said cam to support said coin of one diameter range against sideways movement at at least three points of support.

In another aspect of the invention one of the plates defining the coin chute is provided with a rail substantially longitudinally aligned with the separator rail to receive and direct said coin of one diameter range and thickness into a transverse path.

Preferably in the present coin separator assembly the second coin engageable means includes an outstanding arm supporting the rail.

Preferably in the present coin separator assembly the separator member is hingedly attached to said first plate and the first coin engageable means includes an outwardly projecting cam; said second plate includes a recess providing vertically spaced abutments disposed above and below said cam to support said coin against sideways movement.

Preferably, in the present separator assembly the recess provided in the second plate includes an inclined face receiving and directing said tilted coin.

DESCRIPTION OF THE PREFERRED EMBODIMENT

Figure 1:
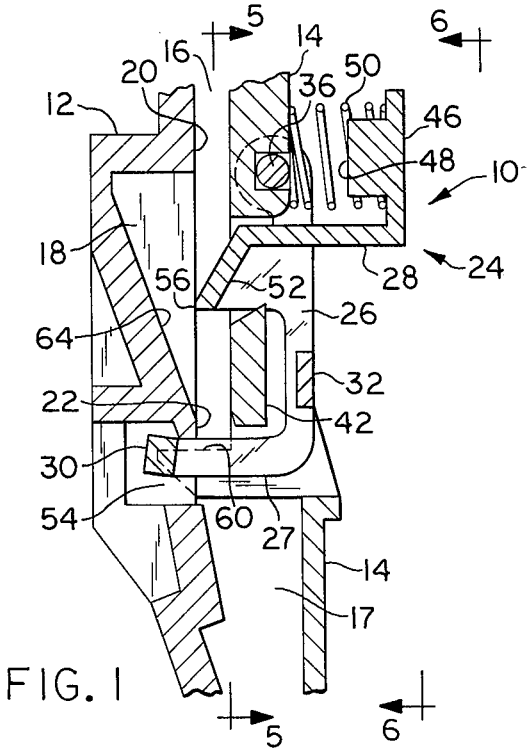
FIG. 1 is a fragmentary cross sectional view of the separator assembly in the rest position.
Figure 5:
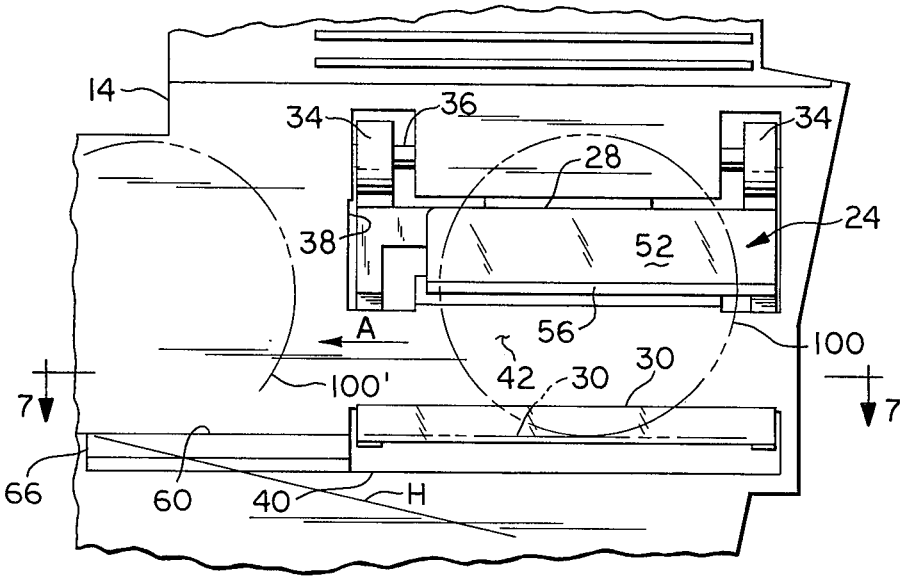
FIG. 5 is a fragmentary front elevational view of the gate taken on line 5—5 of FIG. 1.
Figure 6:
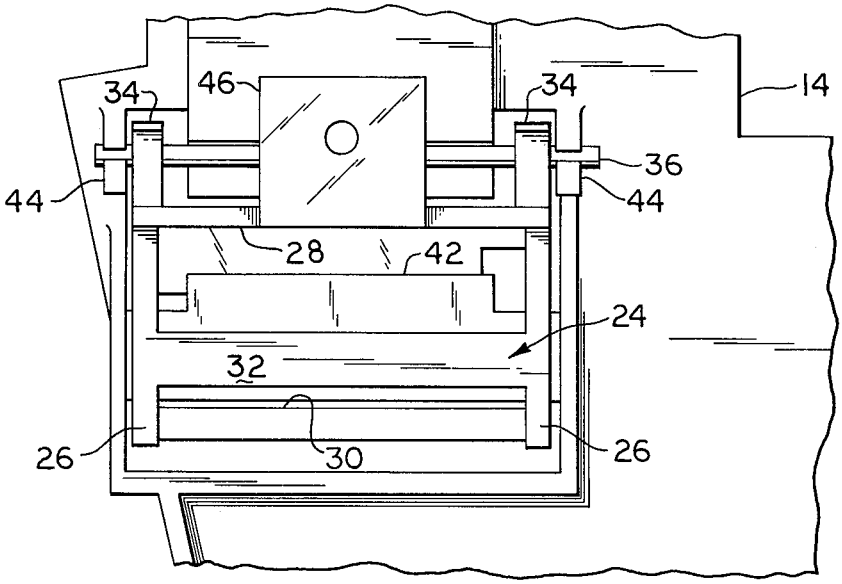
FIG. 6 is a fragmentary rear elevational view of the gate taken on line 6—6 of FIG. 1.

Referring now by characters of reference to the drawings, and first to FIGS. 1, 5 and 6 it will be understood that the coin separator assembly generally indicated by numeral 10 includes a main plate 12 and a gate 14, constituting first and second plates respectively, said main plate and gate being disposed in spaced relation from each other to define a coin chute 16. The main plate 12 includes a recessed portion 18 having a width at least as great as the height thereof to provide spaced upper and lower margin portions 20 and 22 constituting abutment means. A separator member indicated by numeral 24 is hingedly mounted to the gate 14 for swinging movement relative to the gate 14.

In the preferred embodiment shown, the separator member 24 includes a pair of generally ell-shaped side portions 26 interconnected by a transverse upper portion 28, a lower forward portion provided by a rail 30, and an intermediate portion 32. The separator member 24 is provided with a pair of spaced hinge lugs 34 attached to the transverse portion 28 and apertured to receive an elongate hinge pin 36 extending outwardly on each side of said lugs 34.

As best shown in FIG. 5, the gate 14 includes upper and lower openings 38 and 40 which receive, respectively, the upper and lower portions of the swinging separator member 26. The gate also includes a pair of hinge lugs 44 disposed adjacent the ends of the upper gate opening 38 and having aligned openings configurated to receive the hinge pin 36. As will be readily understood this structural arrangement of parts permits the separator member 24 to swing about a hinge axis defined by said pin 26. As clearly shown in FIGS. 1 and 6 the separator member upper portion 28 includes a spring retained member 46, which is configurated to provide a retaining boss 48 for a compression spring generally indicated by numeral 50, said spring extending between the separator member 24 and the face of the gate 14. The gate is recessed to receive the hinge pin 36.

The structural arrangement of parts described above provides that when the separator member 24 is moved from the rest position shown in FIG. 1, in a counter-clockwise direction, the spring 50 provides a resilient biasing means tending to return it to the rest position. In the rest position, the inclined forward part of the transverse upper portion 28 extends into the chute 16 and provides a camming arm 52. The arm 52 intercepts the path of the coin received by the chute 16, such that the separator member 24 is rotated rearwardly in a counter-clockwise direction. The rail 30, which is disposed beyond the chute 16 in the rest position and received within an opening 54 formed in the main plate 12, is likewise rotated rearwardly in a counter-clockwise direction and tends to move into intercepting relation with the path of the coin received by the chute 15. The remote end of the camming arm 52, indicated by numeral 56 constitutes a first coin engageable means and the rail 30 constitutes a second coin engageable means. As will be readily understood, the arcuate movement of the rail 30 across the chute is greater than the arcuate movement of the end of the camming arm because of the greater radial spacing of the rail from the hinge axis and the generally vertical alignment of the coin chute 16.

As discussed above, this coin separator assembly is intended to distinguish diametrically undersized coins and slugs, and also underthick coins and slugs from coins of predetermined range and thickness. In the embodiment shown the separator will accept U.S. twenty-five cent (25¢) coins and the new U.S. one dollar ($1.00) coins, the latter being commonly referred to as "Anthony" dollars. Both of these coins in the preferred embodiment constitute coins within one diameter range and thickness and are initially directed into the same transverse path for further separation and testing. Undersized and underthick coins, on the other hand, continue in a downward path for further testing. Such further testing, for metallic content, weight, size and the like are well-known in the art.

Figure 2:
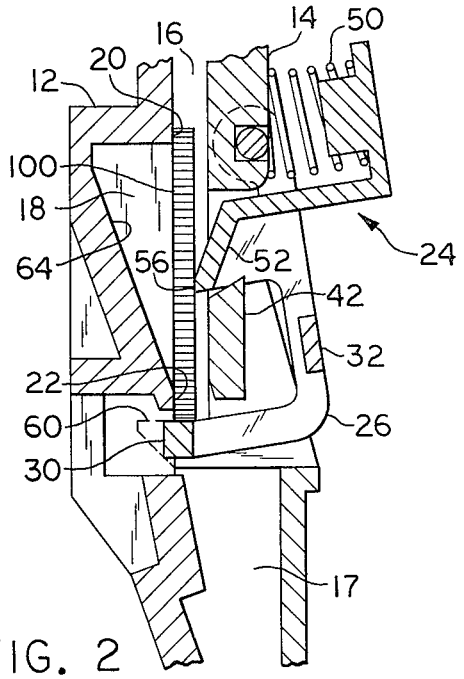
FIG. 2 is a fragmentary cross sectional view, similar to FIG. 1 but showin the disposition of parts with a coin of a particular diametrical size.
Figure 7:
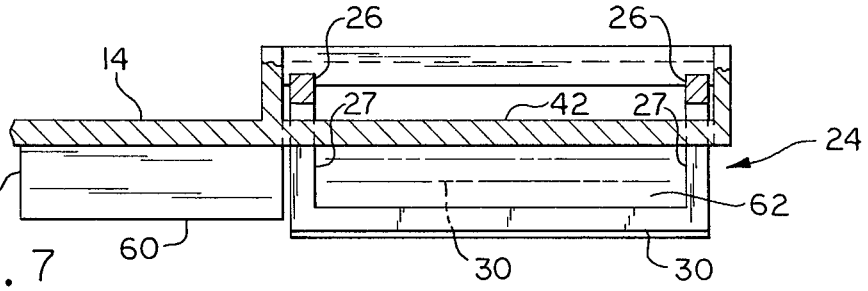
FIG. 7 is a fragmentary cross sectional view taken on line 7—7 of FIG. 5.

The operation of the separator assembly as it relates to coins acceptable for direction into a transverse path is clearly shown by reference to FIG. 2. Such a coin, indicated by numeral 100, is received within the chute 16, defined by the main plate 12 and the gate 14. As it passes down the chute 16, the coin 100 engages the separator camming arm 52 causing counter-clockwise rotation of the separator member 24 against the bias of the spring 50. Any tendency for the lower portion of the coin to move to the left (FIG. 2) under spring bias is countered by the inclined face of the recess. As a result of the counter-clockwise rotation of the separator member 24, the rail 30 moves into intercepting relation with the path of the coin 100. The main plate recess margin portions 20 and 22 are spaced apart a distance less than the minimum diameter of the acceptable coin 100 and the result is that the coin is supported against sideways movement by three-point engagement by the cam remote end 56 on one side and the spaced abutment margin portions 20 and 22 on the other side. Because of the position of the rail 30, further downward movement of the coin 100 is prevented and the coin is supported momentarily by said rail. This position, shown in FIG. 2, is also shown in phantom outline in FIGS. 5 and 7. In this first position of the separator member 24, the rail 30 is aligned with a projecting rail, indicated by numeral 60, provided on the chute side of the gate 14. This rail 60 is aligned with adjacent rail 30 which permits the coin 100 to roll in the direction of arrow A, which is transverse to its original downward direction. The coin 100 thus rolls toward the position indicated by numeral 100' and at the end 66 of the rail 60, is deposited into another chute (not shown) for further testing.

Although, for convenience, the separator assembly 24 is shown in the drawing, FIG. 5, in a horizontal disposition it is, in fact, inclined to facilitate transverse rolling of the coin 100. In the preferred embodiment, the rails 30 and 60 are inclined downwardly at an angle of approximately twelve and one-half degrees ($12\frac{1}{2}°$) as indicated by the location of the imaginary horizontal line shown by H in FIG. 5.

Figure 3:
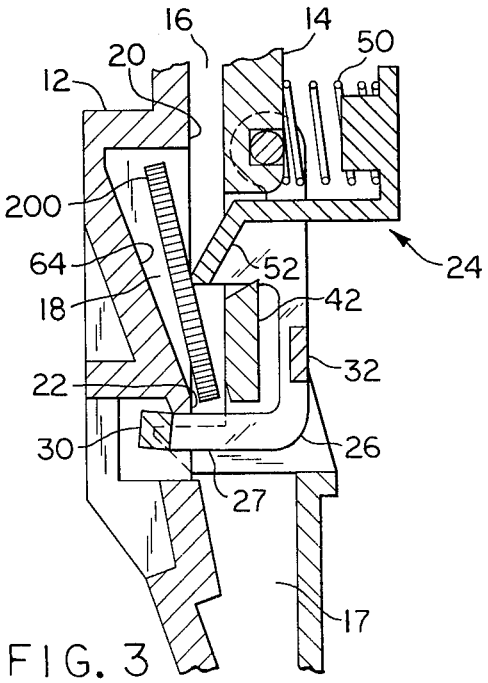
FIG. 3 is a fragmentary cross sectional view, similar to FIG. 1 but showing the disposition of parts with an undersized coin.

The operation of the separator assembly 10 in the event that a diametrically undersized coin 200 is received in the chute 16, is illustrated by FIG. 3. As shown, the coin 200 engages the camming arm 52 causing counter-clockwise rotation of the separator 24 against the bias of the spring 56. However, because the recess margin portions 20 and 22 are spaced apart a distance greater than the diameter of the coin 200, the coin is not held by said margins but moves to the left as the separator member is urged toward its rest position. The result of this is that the camming arm 52 tilts the coin 200 sideways into the recess 18 and the separator member 24 is moved into a second position, which in the preferred embodiment is substantially the rest position, in which the rail 30 is moved out of the path of the coin and away from supporting engagement with the coin 200. This movement permits the coin 200 to slide down the inclined face 64 and to move into and through the opening 62 (FIG. 7) defined by the separator member rail 30 and the outstanding arms 27 supporting said rail, said opening providing a space adjacent the rail 30 leading to the lower portion of the chute indicated by numeral 17.

Figure 4:
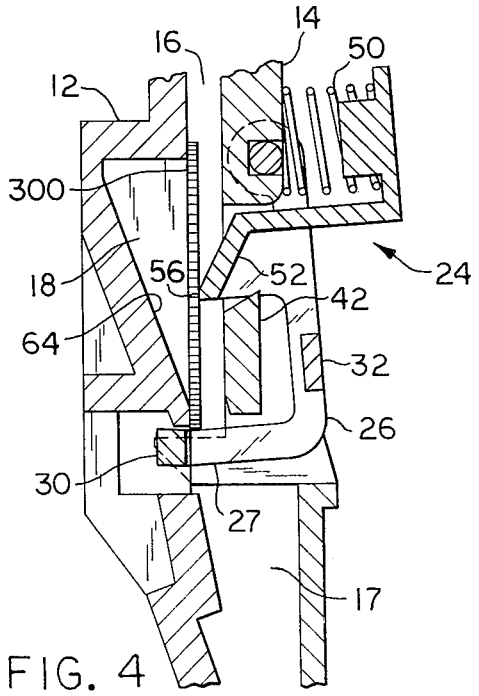
FIG. 4 is a fragmentary cross sectional view, similar to FIG. 1, but showing the disposition of parts with an underthick coin.

The operation of the separator assembly, in the event that an underthick coin 300 is received in the chute 16, is illustrated by FIG. 4. As shown the camming arm 52 operates in much the same manner as with an acceptable coin. However, because of the lack of thickness of the coin 300 the separator member 24 tends to move under spring action to a third position which, as shown in FIG. 4, is somewhat advanced in a clockwise direction relative to the position shown in FIG. 2. The result of this advancement is that the rail 30 is moved out of the path of the coin 300 and away from supporting engagement with said coin which permits the coin 300 to move through the opening 62 and into the chute lower portion 17.

Because of the difference between the radial distance from the hinge axis of the camming arm end 56, which engages the side face of the coin 300, and the rail 30, which engages the lower edge of said coin, the arcuate distance moved by the rail is magnified. Thus, the arcuate movement of the rail 30 is, in the preferred embodiment, greater than the differential of the coin thickness, and this relationship provides the advantage of a more sensitive mechanism.

As will be readily understood rearward counter-clockwise movement of the separator member 24 is limited by engagement of the camming arm 52 with the portion of the gate indicated by numeral 42, which is disposed between the openings 30 and 32, and provides a stop precluding further counter-clockwise movement of the separator member 24. Similarly, engagement of gate portion 42 by the separator member intermediate portion 32 limits clockwise movement thereof.

We claim as our invention:

1. A coin separator assembly, comprising:

(a) a first plate, (b) a second plate, disposed in spaced relation from said first plate to define a coin chute, (c) one of said plate including a coin engageable abutment means, (d) a separator member including a hinge axis, said member being mounted to one of said plates in swinging relation thereto, and said separator member including:

1. a first coin engageable means disposed in spaced relation from the hinge axis, and
2. a second coin engageable means disposed in spaced relation from the hinge axis below said first coin engageable means, (e) biasing means tending to bias said separator member from a first position, in which a coin of one diameter range is supported against sideways movement by said abutment means on one side and said first engageable means on the other side and supported against downward movement by said second engageable means, into a second position, in which a coin of lesser diameter is tilted by said first engagement means to one of side and said second engagement means is moved away from supporting engagement with said coin of lesser diameter to permit said coin to move in a generally downward direction, and (f) said second coin engageable means including:

1. a rail supporting said coin of one diameter range in said first position to direct said coin in a generally transverse direction, and
2. a space adjacent said rail receiving said tilted coin in said second position.

2. A coin separator assembly as defined in claim 1, in which:

(g) said second coin engageable means includes an outstanding arm supporting said rail.

3. A coin separator assembly, comprising:

(a) a first plate, (b) a second plate, disposed in spaced relation from said first plate to define a coin chute, (c) one of said plate including a coin engageable abutment means, (d) a separator member including a hinge axis, said member being mounted to one of said plates in swinging relation thereto, and said separator member including:

1. a first coin engageable means disposed in spaced relation from the hinge axis, and
2. a second coin engageable means disposed in spaced relation from the hinge axis below said first coin engageable means, (e) biasing means tending to bias said separator member from a first position, in which a coin of one diameter range is supported against sideways movement by said abutment means on one side and said first engageable means on the other side and supported against downward movement by said second engageable means, into a second position, in which a coin of lesser diameter is tilted by said first engagement means to one side and said second engagement means is moved away from supporting engagement with said coin of lesser diameter to permit said coin to move in a generally downward direction, and (f) said second coin engageable means including:

1. a rail supporting said coin of one diameter range in said first position to direct said coin in a generally transverse direction when said coin is within one thickness range,
2. a space adjacent said rail receiving said tilted coin in said second position, and
3. said rail being of a width such that engagement by said first engagement means of a coin of said one diameter range, but having a lesser thickness, moves the separator member into a third position in which said rail moves away from supporting engagement with said coin of lesser thickness and said space receives said coin.

4. A coin separator assembly, comprising:

(a) a first plate, (b) a second plate, disposed in spaced relation from said first plate to define a coin chute, (c) one of said plates including a coin engageable abutment means, (d) a separator member including a hinge axis, said member being mounted to one of said plates in swinging relation thereto, and said separator member including:

1. a first coin engageable means disposed in spaced relation from the hinge axis, and
2. a second coin engageable means disposed in spaced relation from the hinge axis below said first coin engageable means, (e) biasing means tending to bias said separator member from a first position, in which a coin of one diameter range is supported against sideways movement by said abutment means on one side and said first engageable means on the other side and supported against downward movement by said second engageable means, into a second position, in which a coin of lesser diameter is tilted by said first engagement means to one side and said second engagement means is moved away from supporting engagement with said coin of lesser diameter to permit said coin to move in a generally downward direction, and (f) said biasing means is a spring disposed between said separator member and one of said plates.

5. A coin separator assembly, comprising:

(a) a first plate, (b) a second plate, disposed in spaced relation from said first plate to define a coin chute, (c) one of said plates including a coin engageable abutment means, (d) a separator member including a hinge axis, said member being mounted to one of said plates in swinging relation thereto, and said separator member including:

1. a first coin engageable means disposed in spaced relation from the hinge axis, and
2. a second coin engageable means disposed in spaced relation from the hinge axis below said first coin engageable means, (e) biasing means tending to bias said separator member from a first position, in which a coin of one diameter range is supported against sideways movement by said abutment means on one side and said first engageable means on the other side and supported against downward movement by said second engageable means, into a second position, in which a coin of lesser diameter is tilted by said first engagement means to one side and said second engagement means is moved away from supporting engagement with said coin of lesser diameter to permit said coin to move in a generally downward direction, and (f) said first coin engageable means including a cam and said abutment means including vertically spaced abutments disposed above and below said cam to support said coin of one diameter range against sideways movement at at least three points of support.

6. A coin separator assembly, comprising:

(a) a first plate, (b) a second plate, disposed in spaced relation from said first plate to define a coin chute, (c) one of said plate including a coin engageable abutment means, (d) a separator member including a hinge axis, said member being mounted to one of said plates in swinging relation thereto, and said separator member including:

1. a first coin engageable means disposed in spaced relation from the hinge axis, and
2. a second coin engageable means disposed in spaced relation from the hinge axis below said first coin engageable means, (e) biasing means tending to bias said separator member from a first position, in which a coin of one diameter range is supported against sideways movement by said abutment means on one side and said first engageable means on the other side and supported against downward movement by said second engageable means, into a second position, in which a coin of lesser diameter is tilted by said first engagement means to one side and said second engagement means is moved away from supporting engagement with said coin of lesser diameter to permit said coin to move in a generally downward direction, and (f) a rail provided on one of said plates substantially longitudinally aligned with said separator member rail to receive and direct said coin into a transverse path.

7. A coin separator assembly, comprising:

(a) a first plate, (b) a second plate, disposed in spaced relation from said first plate to define a coin chute, (c) one of said plates including a coin engageable abutment means, (d) a separator member including a hinge axis, said member being mounted to one of said plates in swinging relation thereto, and said separator member including:

1. a first coin engageable means disposed in spaced relation from the hinge axis, and
2. a second coin engageable means disposed in spaced relation from the hinge axis below said first coin engageable means, (e) biasing means tending to bias said separator member from a first position, in which a coin of one diameter range is supported against sideways movement by said abutment means on one side and said first engageable means on the other side and supported against downward movement by said second engageable means, into a second position, in which a coin of lesser diameter is tilted by said first engagement means to one side and said second engagement means is moved away from supporting engagement with said coin of lesser diameter to permit said coin to move in a generally downward direction, and (f) said separator member being hingedly attached to said first plate and including a cam and said second plate including a recess providing vertically spaced abutments disposed above and below said cam to support said coin of one diameter range against sideways movement at at least three points of support.

8. A coin separator assembly as defined in claim 7, in which:

(g) said recess includes an inclined face receiving and directing said tilted coin.

* * * * *

UNITED STATES PATENT AND TRADEMARK OFFICE

CERTIFICATE OF CORRECTION

PATENT NO. : 4,274,528

DATED : June 23, 1981

INVENTOR(S) : Robert N. Walters & Kristen H. Dietz

It is certified that error appears in the above-identified patent and that said Letters Patent are hereby corrected as shown below:

Column 2:

Line 29, cancel "showin" and substitute --showing--.

Column 5:

Line 44, after the words "engagement means to one" cancel the word "of".

Signed and Sealed this

First Day of September 1981

[SEAL]

Attest:

GERALD J. MOSSINGHOFF

Attesting Officer

Commissioner of Patents and Trademarks